US007478990B2

(12) United States Patent
Wilson

(10) Patent No.: US 7,478,990 B2
(45) Date of Patent: Jan. 20, 2009

(54) BRACKET/SPACER OPTIMIZATION IN BLADELESS TURBINES, COMPRESSORS AND PUMPS

(76) Inventor: Erich A. Wilson, 737 S. 550 East, Springville, UT (US) 84663

( * ) Notice: Subject to any disclaimer, the term of this patent is extended or adjusted under 35 U.S.C. 154(b) by 463 days.

(21) Appl. No.: 11/163,612

(22) Filed: Oct. 25, 2005

(65) Prior Publication Data

US 2007/0092369 A1 Apr. 26, 2007

(51) Int. Cl.
*F01D 1/36* (2006.01)

(52) U.S. Cl. ..... 415/90; 416/185; 416/198 R; 416/223 B

(58) Field of Classification Search ..... 415/56.2, 415/80, 90, 121.2, 149.1, 151, 159, 160, 415/206, 229, 202, 155, 902; 416/185, 198 A, 416/198 R, 223 B
See application file for complete search history.

(56) References Cited

U.S. PATENT DOCUMENTS

| | | | | | |
|---|---|---|---|---|---|
| 1,061,142 | A * | 5/1913 | Tesla | 415/90 |
| 1,061,206 | A | 5/1913 | Tesla | |
| 1,139,562 | A * | 5/1915 | Nash | 415/87 |
| 1,445,310 | A | 2/1923 | Hall | |
| 2,087,834 | A | 7/1937 | Brown et al. | |
| 2,626,135 | A | 1/1953 | Serner | |
| 3,273,865 | A | 9/1966 | White | |
| 3,644,051 | A | 2/1972 | Shapiro | 415/90 |
| 3,668,393 | A | 6/1972 | Von Rauch | 250/49.5 |
| 4,025,225 | A | 5/1977 | Durant | 415/90 |
| 4,036,584 | A | 7/1977 | Glass | 415/90 |
| 4,201,512 | A | 5/1980 | Marynowski et al. | 415/90 |
| 4,402,647 | A | 9/1983 | Effenberger | 415/90 |
| 4,416,582 | A * | 11/1983 | Glass | 415/59.1 |
| 4,586,871 | A * | 5/1986 | Glass | 415/90 |
| 4,652,207 | A | 3/1987 | Brown et al. | 415/90 |
| 5,419,679 | A | 5/1995 | Gaunt et al. | 415/90 |
| 5,466,119 | A | 11/1995 | Boivin et al. | 415/90 |
| 6,174,127 | B1 | 1/2001 | Conrad et al. | 415/1 |
| 6,183,641 | B1 | 2/2001 | Conrad et al. | 210/512 |
| 6,227,795 | B1 | 5/2001 | Schmoll, III | 415/90 |
| 6,238,177 | B1 | 5/2001 | Conrad et al. | 415/1 |
| 6,261,052 | B1 | 7/2001 | Conrad et al. | 415/90 |
| 6,290,464 | B1 | 9/2001 | Negulescu et al. | 416/97 |
| 6,324,828 | B1 | 12/2001 | Willis et al. | 60/39.03 |
| 6,328,527 | B1 | 12/2001 | Conrad et al. | 415/90 |
| 6,363,712 | B1 | 4/2002 | Sniegowski et al. | 60/39.75 |
| 6,932,313 | B1 | 5/2002 | Epstein et al. | 290/52 |
| 6,526,757 | B2 | 3/2003 | MacKay | 60/773 |
| 6,692,232 | B1 | 2/2004 | Letourneau | 416/198 |
| 6,726,442 | B2 | 4/2004 | Letourneau | 415/90 |
| 6,726,443 | B2 | 4/2004 | Collins et al. | 415/90 |
| 6,779,964 | B2 | 8/2004 | Dial | 415/1 |
| 6,814,537 | B2 | 11/2004 | Olsen | 415/111 |
| 7,192,244 | B2 * | 3/2007 | Grande et al. | 415/90 |

* cited by examiner

*Primary Examiner*—Igor Kershteyn

(57) ABSTRACT

A bracket/spacer design in a bladeless turbine, compressor or pump comprising of a hub for axial mounting and one or more arms connected to the hub. This bracket/spacer configuration contributes in part or completely to form one or more fluid flow chambers along with coinciding geometry of the neighboring disk or disks facilitating the entrance or exit of fluid for the purpose of extracting or infusing energy into or from the fluid. Furthermore, this invention includes a precise description of non-constant angular and axial geometry of the bracket/spacer arm or arms.

5 Claims, 2 Drawing Sheets

BRACKET/SPACER OPTIMIZATION IN BLADELESS TURBINES, COMPRESSORS AND PUMPS

FIELD OF THE INVENTION

This invention relates to the improvement in geometric shape of an individual bracket/spacer used to build bladeless impellers, turbines, compressors, and pumps. This invention offers improvements in the bracket design to increase the efficiency of energy extraction or infusion between the working mechanical components and the working fluid of the system whether the fluid be compressible, incompressible, Newtonian or non-Newtonian in nature.

BACKGROUND

A bladeless turbine design was first patented by Nikola Tesla (U.S. Pat. No. 1,061,206) in 1913 for use as a steam turbine to extract energy from a working fluid. This original patent included the grouping of a series of disks and blades with identical passage holes symmetrically grouped around the rotational axis. The working fluid was introduced at a pressure and temperature through a form of nozzle at an angle on the outer perimeter of the disks. With only the passage holes in the disks as an outlet for the working fluid, it was forced across the disks radially and angularly inward to exit through an axially located flow channel leading to an outlet at one end of the disk assembly which path resulted in reduction of pressure and temperature of the working fluid and the consequent rotation of the disk assembly. This configuration is known as a Tesla, bladeless and/or disk impeller, turbine, compressor or pump. The general concept has been widely implemented as a pump, witnessed in U.S. Pat. No. 3,644,051 (Shapiro); U.S. Pat. No. 3,668,393 (Von Rauch); and U.S. Pat. No. 4,025,225 (Durant) and as a turbine witnessed in U.S. Pat. No. 1,061,206 (Tesla); U.S. Pat. No. 2,087,834 (Brown et al.); U.S. Pat. No. 4,025,225 (Durant); U.S. Pat. No. 6,290,464 (Negulescu et al.); U.S. Pat. No. 6,692,232 (Letourneau); and U.S. Pat. No. 6,726,443 (Collins et al.). In form without brackets between the disks, the bladeless turbine is referred to as a Prandtl Layer turbine as witnessed in U.S. Pat. No. 6,174,127 (Conrad et al.); U.S. Pat. No. 6,183,641 (Conrad et al.); U.S. Pat. No. 6,238,177 (Conrad et al.); U.S. Pat. No. 6,261,052 (Conrad et al.); and U.S. Pat. No. 6,328,527 (Conrad et al).

Standard practice among individual researchers and hobbyists is to combine multiple disks each of identical outer radius and chamber size in the same turbine, compressor or pump assembly. This method is referred to as a constant-geometry disk assembly and is witnessed in U.S. Pat. No. 1,061,206 (Tesla); U.S. Pat. No. 3,644,051 (Shapiro); U.S. Pat. No. 3,668,393 (Von Rauch); U.S. Pat. No. 4,025,225 (Durant); U.S. Pat. No. 4,201,512 (Marynowski et al.); U.S. Pat. No. 6,227,795 (Schmoll, III); U.S. Pat. No. 6,726,442 (Letourneau); U.S. Pat. No. 6,726,443 (Collins et al.) and U.S. Pat. No. 6,779,964 (Dial).

It has been found by others that variations in the disk shape, referred to here as disk bending, gap differentiation, variation in outer diameters of disks within a single assembly and variation in diameter of flow chambers from one disk to the next alter performances of the disk assembly. Those are listed as follows:

1. Disk bending—U.S. Pat. No. 1,445,310 (Hall); U.S. Pat. No. 2,087,834 (Brown et al.); U.S. Pat. No. 4,036,584 (Glass); U.S. Pat. No. 4,652,207 (Brown et al.).

2. Gap differentiation—U.S. Pat. No. 2,087,834 (Brown et al.); U.S. Pat. No. 4,402,647 (Effenberger).
3. Outer diameter variation—U.S. Pat. No. 5,419,679 (Gaunt et al.); U.S. Pat. No. 6,261,052 (Conrad et al.).
4. Flow chamber diameter variation—U.S. Pat. No. 2,626,135 (Serner); U.S. Pat. No. 3,273,865 (White); U.S. Pat. No. 5,446,119 (Boivin et al.); U.S. Pat. No. 6,183,641 (Conrad et al.); U.S. Pat. No. 6,238,177 (Conrad et al.); U.S. Pat. No. 6,261,052 (Conrad et al.).

In U.S. Pat. No. 2,626,135 (Serner); U.S. Pat. No. 4,402,647 (Effenberger); and U.S. Pat. No. 5,446,119 (Boivin et al.) the spacers, hereto referred as brackets, and gaps between the disks are approached in the disclosed disk assemblies. Serner takes the bridge of the disk and bends it to induce higher efficiency in energy translation from the fluid to the rotor or vice versa. Effenberger tapers the disks to achieve a desired effect on the gap, but shows no interest in deviating from the standard practice in bracket design or outer diameter variation. Boivin et al. include on spacer with a knife-shaped deformable portion to compensate for adjustments when combining a turbomolecular bladeless pump with a stator. These variations are not applicable to the current disclosure. U.S. Pat. No. 4,586,871 (Glass) teaches about hollow composite disks to reduce the stresses on the outer perimeter of the disks. The inventor's design of spacing the disks appears to be axially homogenous regarding thickness and geometry along the x-axis. The inventor refers to inner fences used to guide the fluid and space the disks apart, which act as spacing elements. This method of inner fences are comprised of individual curved, flat strips of material placed between the disks through welding or brazing do not constitute a single solid bracket or spacer as outlined in this disclosure. Glass' method of spacing disks through brazing or welding multiple fences between disks for guiding fluid is further disclosed in U.S. Pat. No. 4,416,582 (Glass) and U.S. Pat. No. 4,036,584 (Glass) where the disks themselves are shown to be conical or bent in design while the inner fences are shown to lie on the sloping section of the disks. U.S. Pat. No. 7,192,244 (Grande et al.) teaches of a bladeless turbine application where the disks are bent, similar to Glass above, or shaped into an axially conical fashion. Flat spacers between tie disks are placed on the sloping perimeter of the assembly and are not noted to be combined into a single bracket or spacer on a per gap basis as disclosed in the current invention. Further, no specific geometry of the spacers is noted by Grande et al. other than being apparently flat with uniform thickness according to the illustrations resembling a large washer. U.S. Pat. No. 1,139,562 (Nash) implements annular plates consisting of a plurality of vanes mounted in opposite directions so as to provide transverse openings or ports to provide two steam passages. Nash demonstrates vanes comprised of straight and flat material angled with a slope in the axial direction but remain homogeneous thickness in the axial direction. U.S. Pat. No. 1,061,142 (Tesla) discloses disks with spokes which are preferably bent. To space these disks, Tesla implements standard washers which are located at the axis of rotation or shaft but do not extend beyond the hub of a neighboring disk or into the flow channel diameter of a neighboring disk as to block the flow channel as disclosed by Tesla. Although, the bracket/spacer design disclosed here appears to be a fit for the disks in Tesla's patent, no effort is made by Tesla to include such a component. No brackets or spacers beyond a standard washer are disclosed in the drawings.

These issues have brought about the present invention.

SUMMARY OF THE INVENTION

A bladeless impeller, turbine, compressor or pump working with a compressible or incompressible fluid relies on the viscosity and impingement of the fluid to propel the disk assembly through the extraction or infusion of energy from the disk assembly to the fluid. Likewise, when energy is added into the working fluid from the disk assembly, it is through impingement and viscosity of the fluid the energy is transferred. Thus, as a working fluid with lower kinematic viscosity is implemented, the ability of the disks to extract or infuse energy into or from the fluid system is proportionally decreased whether this variational relationship be constant, linear or non-linear in nature.

Generally the distance between the disks in a given assembly is reduced to increase the likelihood of energy exchange between the mechanical and fluid systems as the viscosity decreases. When the working fluid is compressible rather than incompressible the viscosity changes by several orders of magnitude. For example, the kinematic viscosity of an incompressible fluid could be on the order of 1e−1 while the kinematic viscosity of a compressible fluid could be on the order of 1e-6. The inability to linearly reduce the distance between the disks by such a great factor—as the kinematic viscosity is reduced leads to the conclusion that the mechanical system must work harder to change the pressure and temperature gradients to obtain acceptable performance levels.

The most common implementation of bladeless impellers, turbines, compressors and pumps is with incompressible fluids for this very reason. One can gain satisfactory performances with an incompressible fluid running the bladeless device in a range from 0-25,000 RPM. When implementing a compressible fluid, this range of rotational speed accomplishes very little compression and mass flow. To obtain the design point of bladeless devices with compressible flow, they must be run at greater speeds.

A disk assembly working at such high rotational speeds inherently causes the bridge, or material separating the fluid flow channels and holding the hub of the disks onto the working surface area of the disks to become an object with which the fluid will collide. Said collision or impingement is another method, perhaps the primary method at such high speeds, through which energy is exchanged from the working fluid to the mechanical system or vice versa.

An object of this invention is to define the reference system and the variables necessary to produce variations in bracket/spacer design affecting the assembly and hence the fluid flow chambers beyond those standardly used in prior art.

An object of this invention is to improve disk/bracket assembly performance through implementing geometrical bracket/spacer variations with the arms deviating from a constant angular value in the centerline, median or mean.

An object of this invention is to improve disk/bracket assembly performance through implementing variation in the outermost diameter of the brackets and/or spacers independent of the geometry of the disk assembly.

A further object of this invention is to provide improved geometry to the flow chamber or chambers of the disk/bracket assembly through improving bracket/spacer design to maximize efficiency and improve performances through adhering geometry similar to a teardrop for the fluid flow chamber, thus maximizing the energy extraction or infusion to and/or from the working fluid.

Further, an object of the invention is to provide a variation in width of the bracket/spacer geometries which, based on the implementation of the bladeless turbine, compressor or disk, will maximize the efficiency of energy transfer within various performance parameters.

Further, an object of the invention is to delineate the leading and trailing edges of the bracket/spacer geometries which, based on the implementation of the bladeless turbine, compressor or disk, will maximize the efficiency of energy transfer within various performance parameters.

DETAILED DESCRIPTION OF THE INVENTION

Figure 1:
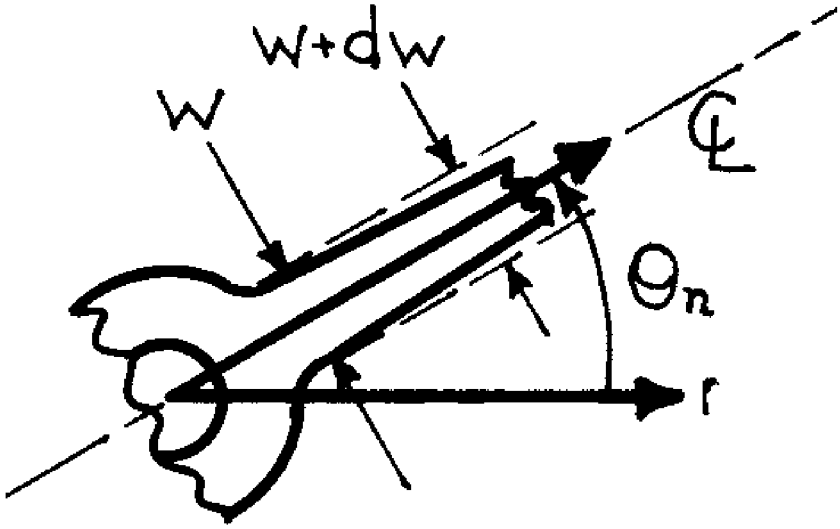
FIG. 1: Variables describing a bracket/spacer with a given angle from the origin, $\theta_n$.

FIG. 1 denotes the variables necessary to explain the improvements provided in this invention as compared to prior art. The origin is placed at the center of rotation with the bracket or spacer extending radially outward in the r-direction and a nominal thickness in the x-direction coming out of the page. A distance, [$\theta_n$], from the angular origin of an arm of the bracket or spacer is located by its centerline, [CL(r)], of constant angular direction for prior art and extending into the radial direction. Said arm is given a physical width, [w(r)], as a function of radial location as well as a decrease in width, [dw(r)], as it distances from the origin. Thus, the following definitions are given:

Definition List 1

| Term | Definition |
|---|---|
| d | First order differential for width |
| m | An integer denoting the number of arms |
| n | An integer of value 1, 2, 3, . . . k − 1, k |
| r | Radial direction |
| $R_{ID}$ | Inner diameter of the bracket/spacer arm(s) |
| $R_{OD}$ | Outer diameter of the bracket/spacer arm(s) |
| w | Arm width |
| x | Axial direction |
| δ | Angular spacing distance between arms on a single bracket/spacer |
| θ | Angular direction |

Said arm may be a single unit or more than one unit combined on the bracket or spacer. In general practice, the number of arms, m, may vary between two and six or more and are angularly spaced a distance, δ, apart. Each of the arms and the consequential fluid flow chambers has a given diameter, $R_{ID}$, which in prior art are constant in value. Each of the bracket/spacer arms separate from the fluid flow chambers has a given outer diameter, $R_{OD}$. Each bracket/spacer arm begins with a leading edge at location $\delta_{m-1}+0.5w(r)_{m-1}$ and ends with a trailing edge at $\delta_m+0.5w(r)_m$ where in prior art $w(r)_{m-1}-0.5w(r)_m$.

Figure 2A:
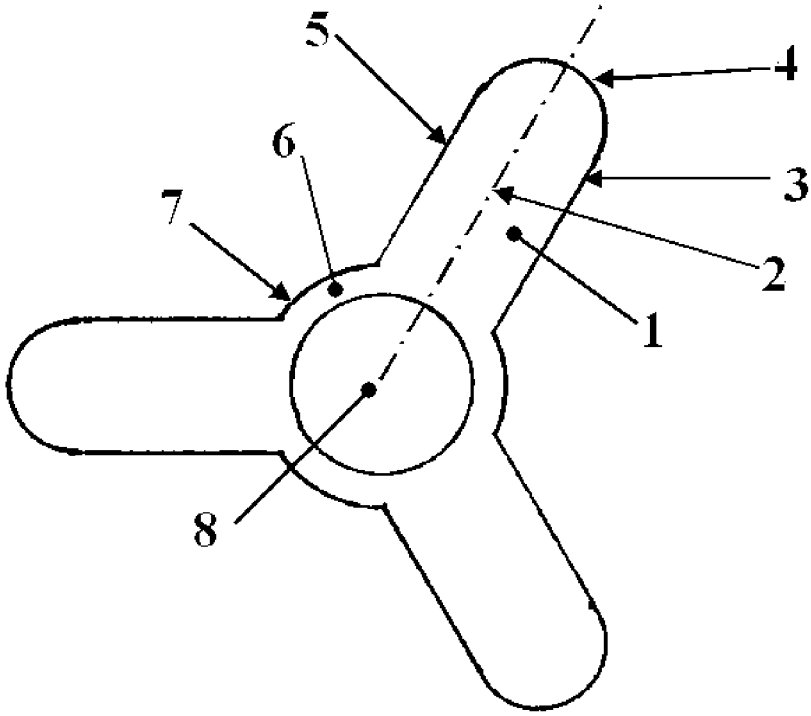
Prior Art FIG 2a
FIGS. 2*a*, 2*b*: Prior art bracket design.
Figure 2B:
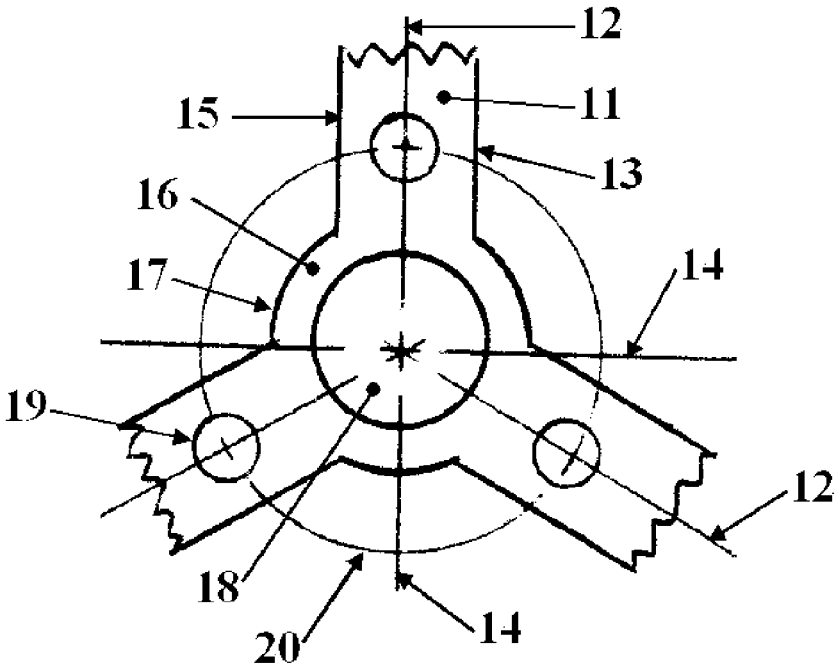
Prior Art FIG 2b

FIGS. 2*a* & 2*b* demonstrate the prior art described above for a bracket or spacer used in bladeless turbine, compressor or pump assembly. A prior art bracket or spacer consists of one or more arms [1] & [11] whose shape and design can be described by a center, mean, or median line [2] & [12] as a radially-dependent function only, such that CL(r). Said arms in prior art are symmetrically equal to each other with leading edge [3] & [13] a constant outer diameter, $R_{OD}$, for the tips of the arms [4] & [14] as well as a trailing edge [1] & [15]. The distance between the leading and trailing edge of an arm, considered to be the width, w(r), of the arm, is either constant or linearly varying in the radial direction such that w(r)+dw (r)/dr where dw(r)/dr is a negative constant value as the arm extends outward. Further, each bracket and/or spacer consists of a hub [6] & [16] with an outer diameter whose radius generally coincides directly with the inner radius, RID, of an arm [1] & [11] to which an arm or arms [1] &[11] are attached and the unit attaches to a shaft or assembly at a mount location [8] & [18]. FIG. 2*b* goes further to demonstrate prior art method of attaching a bracket, spacer or disk to the assembly with a single screw, screw hole or pinhole [19], located in each arm [1] & [11] at a given diameter [20] from the center.

Figure 3:
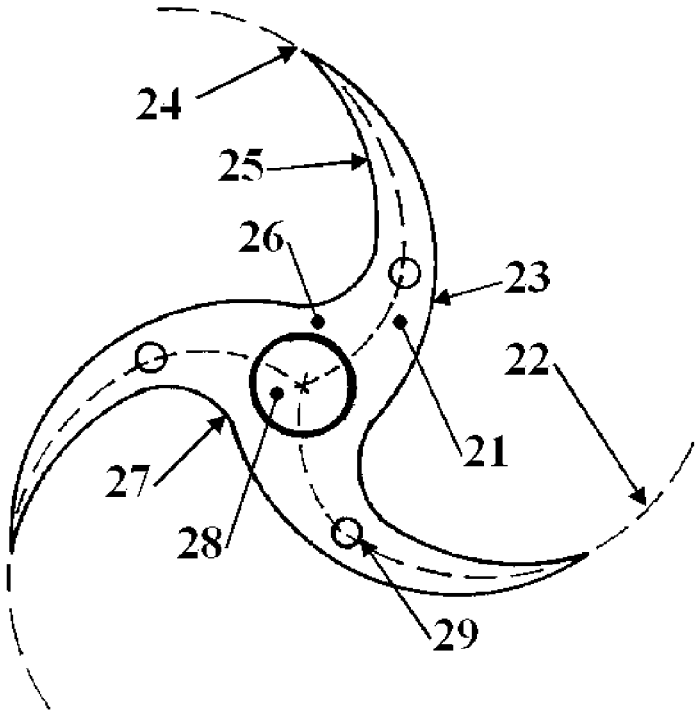
FIG. 3: Improved bracket/spacer design demonstrating all possible improvements combined in one form.

FIG. 3 demonstrates a combination of improvements to the bracket/spacer design. In no fashion does it limit the implementation of these improvements individually, as groups or all together as depicted in FIG. 3. The improved bracket or spacer consists of one or more arms [21] whose shape and design can be described by a center, mean or median line [22] as a three-dimensional function, such that CL(r,θ,x). Said arm or arms [21] may or may not be symmetrically equal to each other in geometry but all consist of two edges [23] & [25] with an outer diameter, ROD(r,θ,x), constant and varying in any of the three dimensions locating the tip of an arm [24]. Said tip of an arm [24] may be rounded or pointed. Which edge is determined to be the leading or trailing edge is dependent on the implementation of the unit and direction of rotation. The distance between the two edges of an arm [21], considered to be the width c(r,CL,x), of that arm, can be constant, linear or non-linear in the r, CL, and/or x directions such that the width along the arm may be described as w(r,CL,x)+V w(r,CL,x), remembering that CL denotes a center, median or mean line [22] of an arm in question. Further, each bracket and/or spacer consists of a hub [26] which may have but is not limited to an outer radius generally coincides directly with the inner radius, RID, of one or more arms [21] to which one or more arms [21] is attached and the unit attaches to a shaft or assembly at a mount location [28]. Further, said bracket and/or spacer may or may not have a method of attaching it to the assembly through sintering or the use of one or more screws, screw holes or pin holes [29] located in each arm [21]. Each hole may be independently located or fixed to a given radius from the center.

The above figures depict, but do not limit in concept the intention of the invention, possible flow optimizations through the combination of design and variation of individual bracket/spacer geometries in a given assembly of a bladeless compressor, pump or turbine. The geometry of an individual bracket/spacer is recommended in this invention, but does not limit as to the possible design or configuration of the bracket/spacer, to be maximized for compression or energy extraction purposes. These designs may be oriented in the assembly in any fashion to maximize the efficiency of energy addition or extraction to the compressible or incompressible working fluid.

What is claimed is:

1. A one piece bracket and/or spacer attached to a single disk or disks, said single disk or disks comprises a generally planar geometry, said bracket and/or spacer comprising a rotational axis said bracket and/or spacer comprises an axial geometry which is generally flat, tapered or contoured such that it completely spans the axial distance between two disks or acts as an inlet/outlet structure when adjacent to said single disk, is used with gaseous or liquid working fluid and implemented as a component of a disk assembly creating a distance between disks or shapes said inlet/outlet structure at the end of said disk assembly of a bladeless compressor, pump or turbine further comprising:

geometry and function independent of attachment to a neighboring disk; and comprising a hub at or around the axis of rotation extending outward away from the axis of rotation and initially contouring in a non-linear fashion along flow chambers of the neighboring disk or disks, and defining multiple separate flow chambers between each two neighboring disks.

2. The one piece bracket and/or spacer as recited in claim 1 further comprising:

two or more nonlinear extensions or arms radially protruding from the perimeter of the hub which comprises of leading and trailing edges and a tip.

3. The one piece bracket and/or spacer as recited in claim 1 further comprising:

two or more nonlinear extensions or arms radially protruding from the perimeter of the hub which comprises of leading and trailing edges and a tip; and which extend radially following a nonlinear center line up to the outer diameter of the fluid flow chambers of the neighboring disk or disks; and with each arm having a varying width which conforms to all or part of the fluid flow chambers of the neighboring disk or disks.

4. The one piece bracket and/or spacer as recited in claim 1, further comprising:

two or more nonlinear extensions or arms radially protruding from the perimeter of the hub which comprises of leading and trailing edges and a tip; and which extend radially following a nonlinear center line up to the outer diameter of the fluid flow chambers of the neighboring disk or disks; and whose arms continue radially beyond the outer diameter of the fluid flow chambers of the neighboring disk or disks such that their extension follows a nonlinear center line.

5. The one piece bracket and/or spacer as recited in claim 1, further comprising:

two or more nonlinear extensions or arms radially protruding from the perimeter of the hub which comprises of leading and trailing edges and a tip; and which extend radially following a nonlinear center line up to the outer diameter of the fluid flow chambers to the neighboring disk or disks; and whose arms continue radially beyond the outer diameter of the fluid flow chambers of the neighboring disk or disks such that their extension follows a nonlinear centerline; and whose arms extend the outer diameter of the fluid flow chambers of the neighboring disk or disks having a varying width.

* * * * *